United States Patent [19]

Haga et al.

[11] Patent Number: 4,610,614

[45] Date of Patent: Sep. 9, 1986

[54] VANE PUMP

[75] Inventors: Kyosuke Haga, Anjo; Tsuneo Tanaka; Toshifumi Sakai, both of Okazaki, all of Japan

[73] Assignee: Toyoda Koki Kabushiki Kaisha, Kariya, Japan

[21] Appl. No.: 696,514

[22] Filed: Jan. 30, 1985

[30] Foreign Application Priority Data

Feb. 1, 1984 [JP] Japan ..... 59-17933
Feb. 3, 1984 [JP] Japan ..... 59-18573

[51] Int. Cl.[4] ..... F04C 18/00
[52] U.S. Cl. ..... 418/269
[58] Field of Search ..... 418/259, 150, 266–269

[56] References Cited

U.S. PATENT DOCUMENTS

| | | | |
|---|---|---|---|
| 1,743,539 | 1/1930 | Gasal | 418/269 |
| 3,102,493 | 9/1963 | Davin | 418/268 |
| 3,211,104 | 10/1965 | Rosaen | 418/268 |
| 3,223,044 | 12/1965 | Adams | 418/267 |
| 3,781,145 | 12/1973 | Wilcox | 418/268 |
| 3,869,231 | 3/1975 | Adams | 418/267 |

*Primary Examiner*—Leonard E. Smith
*Assistant Examiner*—Jane E. Obee
*Attorney, Agent, or Firm*—Oblon, Fisher, Spivak, McClelland & Maier

[57] ABSTRACT

In a vane pump, a pump housing contains a cam ring having an internal cam surface, in which a rotor carrying eight vanes is rotatable by a drive shaft. A pair of side plates positioned in the receiving bore in contact engagement with the opposite end surface of the cam ring, the internal cam surface and the rotor define a pump chamber. Each of the side plates is formed at its inside surface contacting the cam ring with a pair of intake ports, a pair of exhaust ports and a vane back pressure groove. This groove is always filled with pressurized fluid supplied from the exhaust ports such that the pressurized fluid is directed into vane support slits formed in the rotor. The angular width between the start point of each of the intake ports and the start point of one of the exhaust ports is chosen to an angle of 90 degrees which is twice the pitch of the vanes, and the angular width of each of the exhaust ports is chosen to be not larger than or angular width which outer end surfaces of two successive vanes make, whereby the volume of pressurized fluid which leaks from the vane back pressure groove towards the intake ports through a clearance between the rotor and each side plate can be maintained constant.

3 Claims, 11 Drawing Figures

VANE PUMP

BACKGROUND OF THE INVENTION

1. Field of the Invention

The present invention relates to a vane pump suitable for use in a power steering system.

2. Description of the Prior Art

Recently, power steering systems for motor vehicles tend to use a pressure balance type vane pump having eight vanes in place of those having twelve or ten vanes. Vane pumps with eight vanes are advatageous in that they are lightweight and easy to machine because the number of vanes is small, although they are liable to suffer from variation in discharge volume due to various causes and to generate pressure pulsation caused by the variation in discharge volume. The generation of pressure pulsation is attributed mainly to the following two causes. The first is the variation in theoretical discharge volume which is geometrically calculated based upon the shapes of a cam ring, vanes and the like, and the second is the variation in volume of fluid leakage inside the pump, that is, the variation in volume of leakage depending upon the pump stages within which pressurized fluid leakage occurs.

It is to be noted herein that the aforementioned variation in theoretical discharge volume constitutes an amplitude variation which coincides with the difference between the maximum and minimum values on a curve which indicates discharge volumes at respective angular positions of a pump rotor. It is also to be noted that the value (i.e., the absolute value of the discharge volume) which is obtained by integrating values on the volume curve has no relation to pulsation, although it influences the pump efficiency.

Generally, a cam curve along which the vanes are moved is composed of an intake curve section C1, a large circular section C2, an exhaust curve section C3 and a small circular section C4, as illustrated by means of an expansion plan of FIG. 1. In pumps of this kind, the variation in volume of a chamber is defined by two successive vanes which, respectively, come up to, and go away from an exhaust port OP when a rotor R is moved a unit angle $\Delta\theta$ to produce a pump discharge volume. This discharge volume is constant if both the large circular section C2 and the small circrlar section C4 are perfectly circular. However, the large circular section C2 is customarily given a slight gradient for preparatory compression. Accordingly, the discharge volume per unit angle of rotor rotation varies depending upon the preparatory compression gradient and has a discharge volume variation X1 of relatively small amplitude, as shown in FIG. 3. This discharge volume variation is generally called "basic discharge volume variation."

Further, since the vanes V are subjected to fluid pressure which exists in a vane back pressure groove G communicating with the exhaust ports OP, the vanes V which move along each intake port IP are extended radially outwardly when the rotor R is rotated the unit angle $\Delta\theta$. This results in consumption of part of the pump discharge volume corresponding to the variation in volume of vane support slits of the rotor R which support the radial extension of the vanes V. Such consumed volume is in proportion to the degree of outward radial extension of the vanes per the unit angle of roation of the rotor R and corresponds to a velocity curve (A in FIG. 1) relating to a vane moving locus. Assuming now, for example, that a vane V1 is at a position ($\alpha$) on the small circular section C4, a preceding vane V2 is along the intake curve section C1 at a position ($\alpha+45°$), as shown in FIG. 1. As the rotor R rotates, the vane V2 goes away from the intake curve section C1 before the vane V1 comes to the intake curve section C1. When rotation is further advanced, only the vane V1 resides on the intake curve section C1, and a transition occurs such that the extension movement of the vane V1 is decelerated after reaching a maximum velocity. For this reason, and because any portion of the intake curve section C1 and the exhaust curve section C3 is composed of constant acceleration curve (A) shown in FIG. 1 for reliable movement of each vane, the fluid volume consumed by vane extension movement within the intake area varies depending upon the angular position of the vane V moving along the intake curve section. C1. In addition, the greater the thickness of each vane V, the larger is the amplitude variation.

Accordingly, the variation X2 in the theoretical discharge volume, which is determined by various factors of the cam and the vanes (that is, which is geometrically calculated based upon the shapes of the cam, vanes and the like), is calculated as the difference between the variation of the above-noted basic discharge volume and the variation of the volume consumed by the vane extension movement and is indicated by an amplitude variation curve (A) as shown in FIG. 4. The variation X2 in theoretical discharge volume (A) is one cause contributing to discharge pressure pulsation.

The pressure in each pump sector, a pump sector being defined by two consecutive vanes V, the cam ring C, the rotor R and the side plates (not shown), is periodically changed from an intake pressure to an exhaust pressure. Because the vane back pressure groove G pressure is always the same as the exhaust pressure and because a slight clearance is required between the rotor R and each of the side plates, leakage of pressurized fluid occurs from the vane back pressure groove G toward each sector being under less pressure than the discharge pressure.

Moreover, the pressure balance type pump with eight vanes is accompanied by a problem in that the number of stages where leakage occurs is periodically changed unless the angular positions of the intake and exhaust ports and the angular widths thereof are adequately designed. For example, each exhaust section covers two pump sectors in a state shown in FIG. 1, while it covers three pump sectors in another state shown in FIG. 2. In this manner, the number of pump sectors which isolate each exhaust section from the two intake sections is alternately changed from three to two, and vice versa, each time the rotor R is advanced one vane pitch. Fluid leakage from the vane back pressure groove G takes place within sections other than the exhaust sections. The stage (i.e., angular area) covering such other sections thus periodically varies, and this causes the volume of fluid leakage to vary as indicated by the curve X3 in FIG. 4.

The variation of actual discharge volume of the pump amounts to the difference between the variation X2 in the above-noted theoretical discharge volume (A) and the variation X3 in leakage volume (B). The variation X2 in theoretical discharge volume (A) is determined solely by various factors of the cam and the vanes, while the variation X3 in leakage volume (B) is determined as a function of the pressure difference between the vane back pressure groove G and the intake sections. Accordingly, the variation X3 in amplitude of the leakage volume (B) becomes larger as the load pressure is increased. As a result, when the pump is operated without a load, the pressure difference between the vane back pressure groove G and the intake sections is small, and hence, the influence by the variation X3 in leakage volume (B) is small, so that the variation of actual discharge volume depends greatly upon the variation X2 in theoretical discharge volume (A). When the pressure difference between the vane back pressure groove G and the intake sections become large due to an increase in the pump discharge pressure, however, the variation X3 in leakage volume (B) is much greater than the variation X2 in theoretical discharge volume (A), so that the variation in actual discharge volume depends largely upon the variation X3 of leakage volume (B).

In vane pumps for vehicle power steering systems, because the load pressure varies markedly, it is particularly important to minimize the variation of discharge volume relative to the discharge pressure change.

SUMMARY OF THE INVENTION

Accordingly, it is a primary object of the present invention to provide an improved vane pump with eight vanes wherein an angular extent within which pressurized fluid leaks from a vane back pressure groove towards intake ports can be maintained constant irrespective of angular positions of the vanes, thereby reducing the amplitude of pulsation in the discharge fluid.

Another object of the present invention is to provide an improved vane pump of the character set forth above wherein the volume of pressurized fluid which is consumed by the radial extension movements of vanes within each intake section can be maintained constant irrespective of angular positions of the vanes, thereby minimizing the pressure pulsation in the discharge fluid.

Briefly, according to the present invention, there is provided a vane pump comprising a cam ring received in a pump housing, a rotor disposed within the cam ring and rotatable by a drive shaft, eight vanes received within vane support slits of the rotor and at least one side plate received in the pump housing in contact engagement with one end surface of the cam ring. The side plate is formed with a pair of intake ports for leading fluid into a pump chamber defined by an internal cam surface of the cam ring, the rotor and the side plate. The side plate is also formed with a pair of exhaust ports for the discharge of fluid pressurized in the pump chamber. A vane back pressure groove formed on the side plate communicates with the exhaust ports for applying pressurized fluid to the vane support slits. Further, the angular width between the starting point of each of the intake ports and the starting point of one of the exhaust port is 90 degrees which is twice the pitch of the vanes, and the angular width of each of the exhaust ports is chosen to be not larger than an angular width which outer end surfaces of two consecutive vanes make.

With this configuration, the angular width within which pressurized fluid leaks from a vane back pressure groove towards each intake port through a side clearance defined at the contact portion of the rotor and the side palte can be maintained constant even if the vanes take any angular positions. This advantageously results in minimizing the variation in the volume of pressurized fluid which leaks from the vane back pressure groove towards each intake port. Accordingly, the variation in the pump discharge volume can be restrained to reduce the amplitude of pulsation in the discharge fluid.

In another aspect of the present invention, each of intake curve sections formed at an internal cam surface of the cam ring is composed of a constant velocity curve portion and acceleration and deceleration curve portions which are respectively disposed at opposite sides of the constant velocity curve portion. Moreover, an angular width between the start points of the acceleration and deceleration curve portions and an angular width between the end points of the acceleration and deceleration curve portions are chosen to be equal to the pitch of the vanes, namely to an angle of 45 degrees. Thus, the volume of pressurized fluid consumed by one or two vanes which are extended radially outwardly when moving along each intake curve section can be maintained constant irrespective of the rotational angular positions of the vanes. This precludes the variation in the pump discharge volume which is caused by the variation in the pressurized fluid consumed by the radial extension movements of vanes, whereby the amplitude of pulsation in the discharge fluid can be reduced.

BRIEF DESCRIPTION OF THE DRAWINGS

The foregoing and other objects and many of the attendant advantages of the present invention will be readily appreciated as the same becomes better understood by reference to the following detailed description of preferred embodiments when considered in connection with the accompanying drawings, wherein like reference numerals designate identical or corresponding parts throughout the several views, and in which.

DESCRIPTION OF THE PREFERRED EMBODIMENTS

Figure 1:
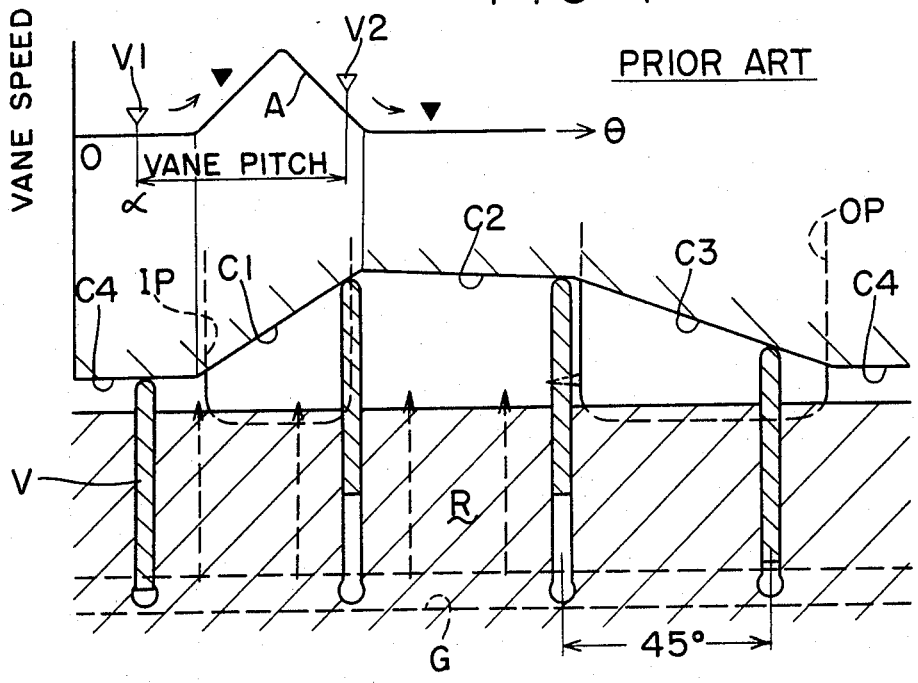
FIG. 1 is an expansion plan showing the configuration of intake and exhaust ports in a known vane pump having eight vanes.
Figure 2:
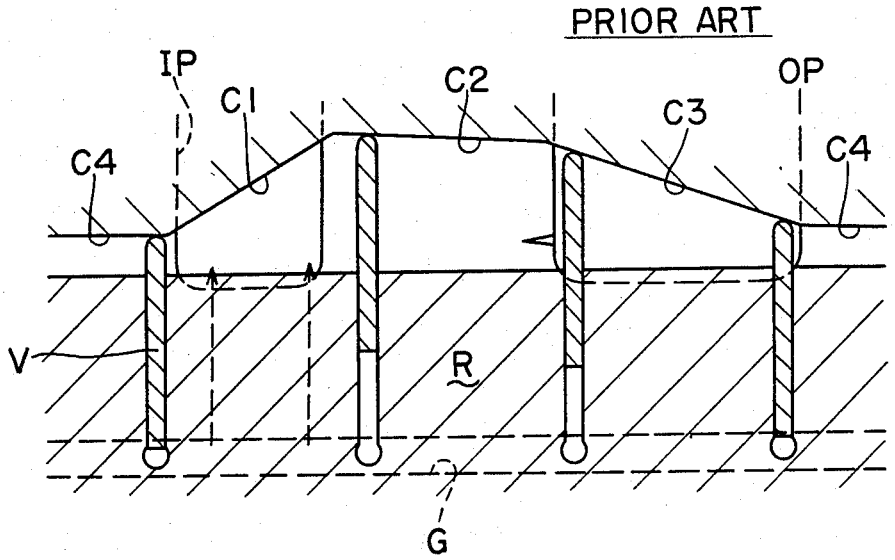
FIG. 2 is an expansion plan similar to FIG. 1, showing however another state wherein the vanes are rotationally moved a slight angle from the state shown in FIG. 1.
Figure 3:
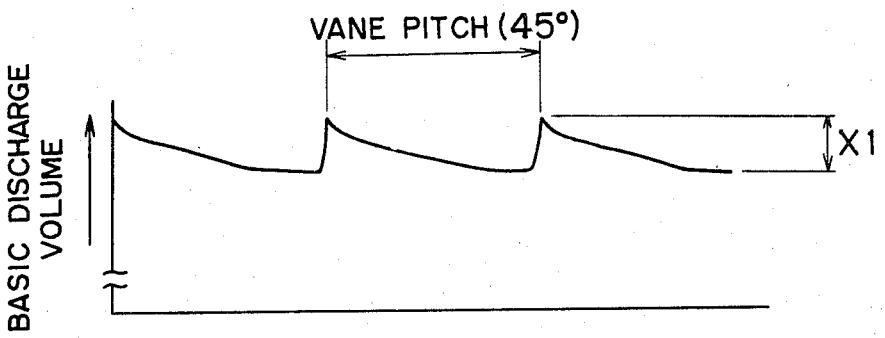
FIG. 3 PRIOR ART
FIG. 3 is a graph indicating the basic discharge volume in the known vane pump.
Figure 4:
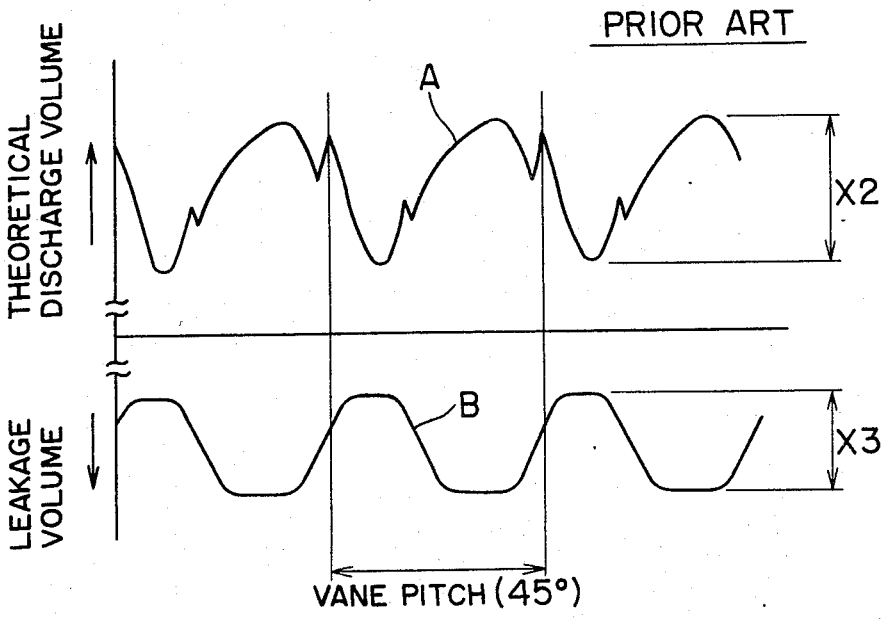
FIG. 4 PRIOR ART
FIG. 4 shows combined graphs indicating the theoretical discharge volume and the leakage volume in the known vane pump.
Figure 5:
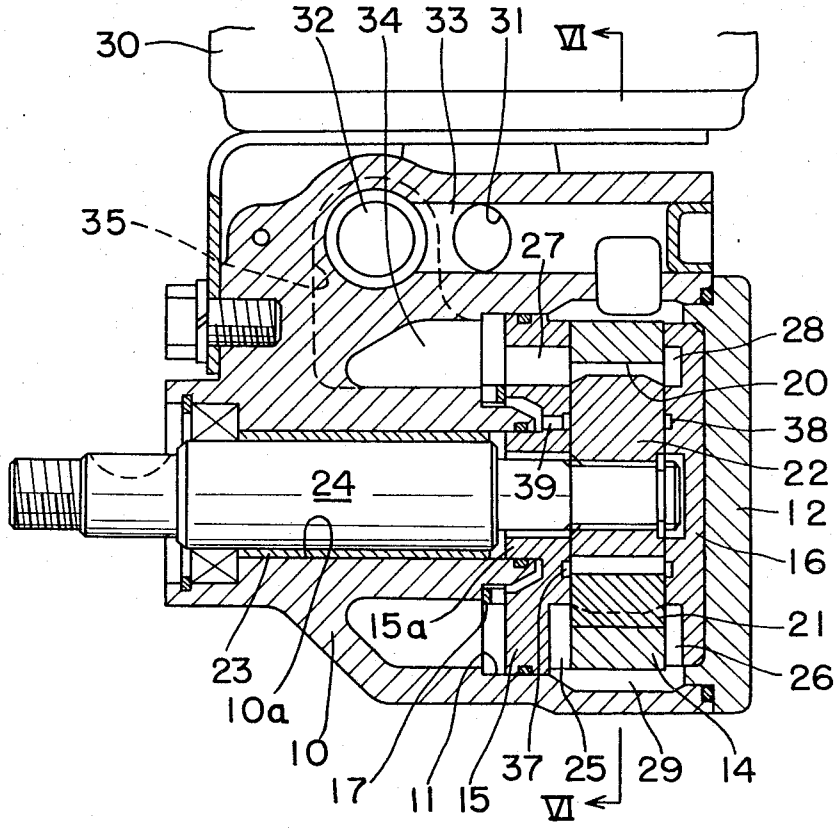
FIG. 5 is a sectional view of a vane pump according to the present invention.
Figure 6:
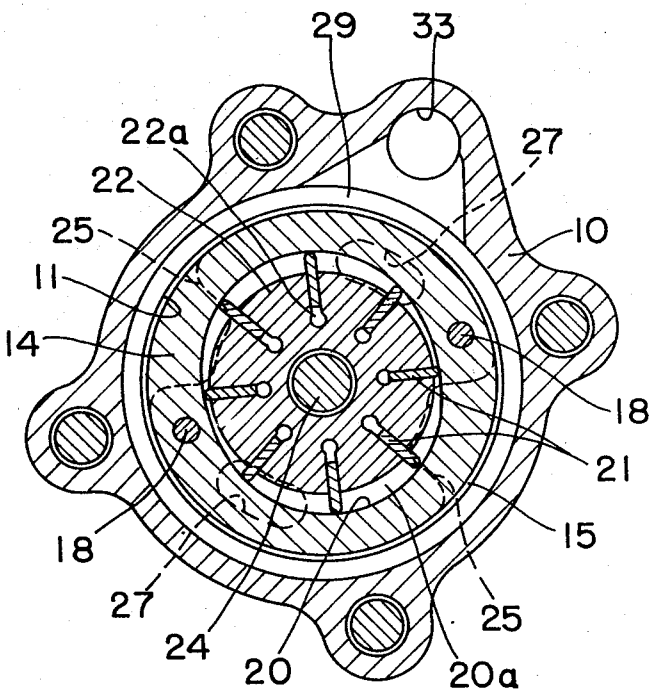
FIG. 6 is a sectional view of the vane pump taken along the line VI—VI in FIG. 5.

Referring now to the drawings and more particularly to FIGS. 5 and 6 thereof, a vane pump according to the present invention is shown having a pump housing 10, which is formed therein with a receiving bore 11 opening at one end of the pump housing 10. An end cover 12 is secured to the pump housing 10 to close the open end thereof. A chamber defined by the receiving bore 11 contains therein a cam ring 14, an annular first side plate 15 contacting one end surface of the cam ring 14, and a disc-like second side plate 16 contacting the other end surface of the cam ring 14 at its one end and the end cover 12 at its other end. The first side plate 15 is formed at its center portion with an annular sleeve portion 15a, which is fitted in a bearing bore 10a of the pump housing 10. A washer spring 17 is compressedly interposed between the first side plate 15 and the pump housing 10 such that the force of the washer spring 17 brings the cam ring 14, the pair of side plates 15 and 16 and the end cover 12 into contact engagement. A pair of locating pins 18 extend between the pump housing 10 and the end cover 12 to hold the cam ring 14 and the side plates 15 and 16 against rotation.

The cam ring 14 is formed with an internal cam surface 20 which is approximately oval, as discussed later. Disposed within the cam ring 14 is a rotor 22 which has eight radially extensible vanes 21 in vane support slits **22*a* formed therein for sliding movements along the internal cam surface 20. The axial width of the rotor 22 and the vanes 21 is chosen to be slightly less than that of the cam ring 14. Thus, when the side plates 15 and 16 are in contact with the opposite end surfaces of the cam ring 14, respectively, a proper side clearance (i.e., a clearnce in the axial direction) is maintained between the rotor 22 and each of the side plates 15, 16. The rotor 22 is in spline connection with one end of a drive shaft 24, which is rotatably disposed in a bearing sleeve 23 fitted in the bearing bore 10a of the pump housing 10**.

With the configuration described above, there are defined a plurality of pump sectors by the vanes 21 dividing a pump chamber **20*a* defined by the internal cam surface 20 of the cam ring 14, the side plates 15, 16 and the outer surface of the rotor 22. The volume of each of the pump sectors varies with rotation of the rotor 22. Each of the side plates 15, 16 are formed with a pair of intake ports 25, 26 and a pair of exhaust ports 27, 28, respectively, at its inside surface facing the rotor 22. Each of the intake ports 25, 26 is located in a position to correspond to an angular extent within which each of the pump sectors performs an expansion operation, while each of the exhaust ports 27, 28 is located in a position corresponding to another angular extent within which each of the pump sectors performs a compression operation. The intake ports 25, 26 open to a supply chamber 29, which is formed so as to surround the cam ring 14 in the receiving bore 11. The supply chamber 29 is in fluid communication with a suction passage 31 leading to a reservoir 30 and a bypass passage 33 having fitted therein a flow volume control valve 32. Each of the exhaust ports 27 extends through the first side plate 15 and communicates with a discharge chamber 34 formed between the first side plate 15 and the pump housing 10. The discharge chamber 34 communicates with a pressurized fluid delivery port (not shown) through a throttle passage (not shown) formed on a discharge passage 35 and further communicates with the above-noted bypass passage 33 via the flow volume control valve 32. The inside surfaces of the side plates 15, 16 are formed with circular or arcuate vane back pressure grooves 37, 38, respectively, facing the radial inner ends of vane support slits 22a formed in the rotor 22. The vane back pressure grooves 37, 38 are in fluid communication with the discharge chamber 34 via one or more communication holes 39 so as to introduce pressurized fluid into the vane support slits 22*a***.

Figure 7:
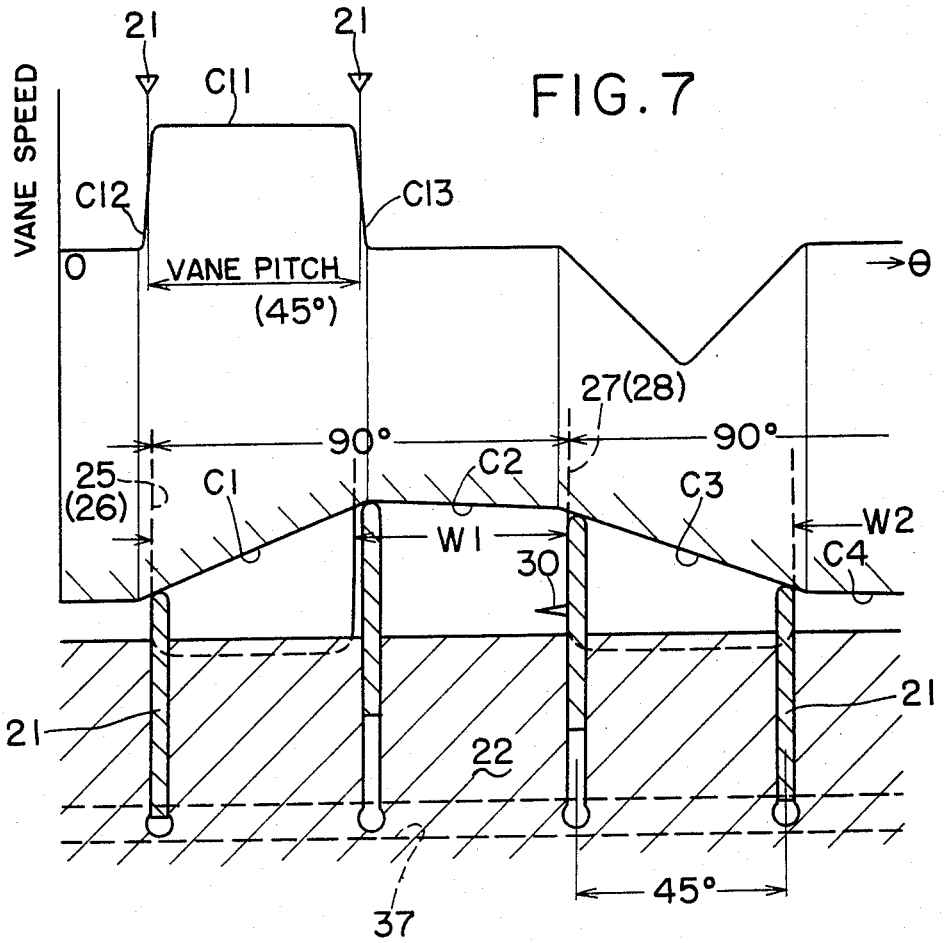
FIG. 7 is an expansion plan of a part of the vane pump shown in FIG. 5, also showing a velocity curve of vane extension movement.

Description will now be made with respect to specific configurations of the internal cam surface 20 of the cam ring 14, the intake ports 25, 26 and the exhaust ports 27, 28. FIG. 7 illustrates an expansion plan covering half of the pump chamber **20*a*. It is to be noted that the remaining half of the pump chamber 20*a* is identical to the illustrated half. The internal cam surface 20 has a cam curve which is formed by smoothly connecting an intake curve section C1, a large circular section C2, an exhaust curve section C3 and a small circular section C4. The intake curve section C1 is of a constant-velocity gradient, and the large circular section C2** has a slight gradient for preparatory compression.

Each intake port 25 (26) opening corresponding to the intake curve section C1 and each exhaust port 27 (28) opening corresponding to the exhaust curve section C3 are spaced circumferentially via a large diameter closed section W1 and a small diameter closed section W2. That is, the angular width which begins from the starting point of each intake port 25 (or 26) and which ends at the starting point of each exhaust port 27 (or 28) are chosen to be at an angle which is twice the vane pitch (i.e., 90 degrees), and the angular width of each exhaust port 27 (or 28) is chosen to an angle which is the sum of the vane pitch and the thickness of one vane 21.

It is to be noted herein that the angular width of each exhaust port 27 (or 28) may be made smaller than the above-defined angular width. In this case, the angular width of the small diameter closed section W2 can be made larger by the angle which is reduced from the angular width of each exhaust port 27 (or 28). In order to realize an efficient pumping action by preventing the fluid communication of each intake port 25 (or 26) with the exhaust ports 27 and 28, it is necessary to make the angular width of the large diameter closed section W1 larger than the vane pitch. To this end, the angular width of each intake port 25 (or 26) is made smaller than the vane pitch.

Reference numeral 30 denotes a lead which is formed on each of the side plates 15, 16. This lead 30 extends circumferentially from the start point of each exhaust port 27 (or 28) toward one of the intake ports 25 (or 26) which is located behind each exhaust port 27 (or 28) in the rotational direction of the rotor 22. The lead 30 is provided for gradually introducing the high pressure fluid in each exhaust port 27 (or 28) into the large diameter closed section W1 wherein fluid is under preparatory compression. The large diameter closed section W1 is isolated from the intake and exhaust ports 25 (or 26), 27 (or 28) when any consecutive two of the vanes 21 move between each intake port 25 (or 26) and each exhaust port 27 (or 28). That is, such gradual introduction of high pressure into the large diameter closed section W1 prevents an abrupt pressure variation in the preparatory compressed fluid contained therein.

Assuming now that the rearward surface of a certain vane 21 is in radial alignment with the starting point of each intake port 25 (or 26) as shown in FIG. 7, a first preceding vane 21 is located at a position which is slightly ahead of the end point of the intake port 25 (or 26), and the rearward surface of a second preceding vane 21 is in radial alignment with the starting point of the exhaust port 27 (or 28). Further, the third preceding vane 21 takes a position to radially align its forward surface with the end point of each exhaust port 27 (or 28).

A vane pump according to the present invention is constructed as described above, and when the rotor 22 is rotated bodily with the drive shaft 24, operating fluid is sucked from the supply chamber 29 into the pump chamber via the intake ports 25, 26. Rotation of the rotor 22 further causes discharge fluid to be exhausted from the pump chamber into the discharge chamber 34 via the exhaust ports 27 and 28, and a part of discharge fluid controlled by the flow volume control valve 32 provided in a discharge passage 35 is then delivered to, for example, a power steering apparatus (not shown).

As the pressure of the discharge fluied is increased, pressurized fluid begins to leak from the vane back pressure grooves 37, 38 toward the intake ports 25, 26 through the side clearances between the rotor 22 and the side plates 15, 16. According to the present invention, however, it is possible to maintain the number of pump sectors, which permit the pressurized fluid to leak from the vane back pressure grooves 37, 38 toward the intake ports 25, 26, constant even if the vanes 21 assume any rotational positions. This can be easily understood if states occurring before and after the state shown in FIG. 7 are taken into consideration. That is, immediately before the state shown in FIG. 7, the state shown in FIG. 8 occurs in which two pump sectors, defined by the three of the first, second and third vanes 21A, 21B and 21C, are under an intake pressure Ps, whereas two other pump sectors, defined by the third, fourth and first vanes 21C, 21D and 21A, are under an exhaust pressure Pd. Thus, the leakage of pressurized fluid from the vane back pressure grooves 37, 38 toward each intake port 25 (or 26) occurs within an angular extent 1 defined by the first through third vanes 21A–21C.

Figure 8:
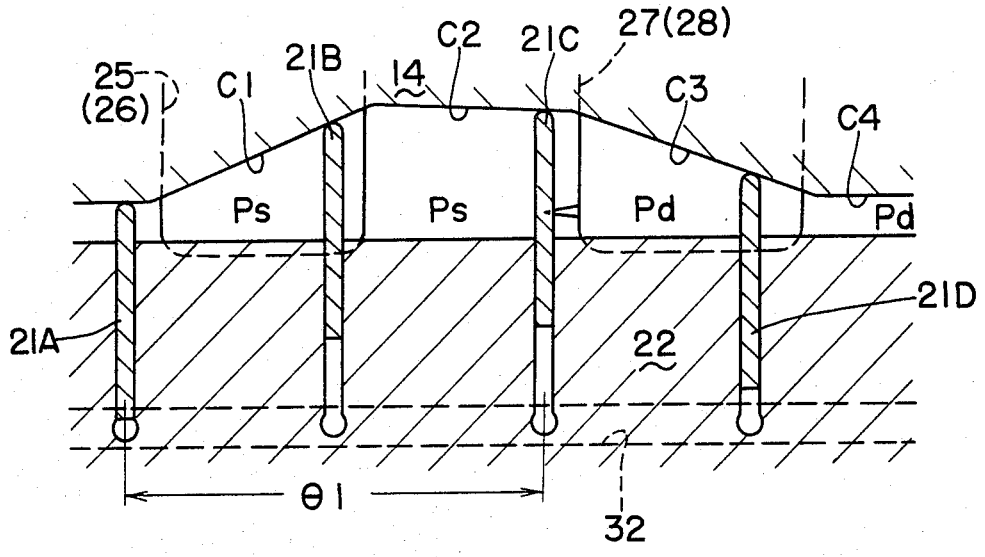
FIG. 8 is an expansion plan of the part shown in FIG. 7 illustrating a state different from that shown in FIG. 7.
Figure 9:
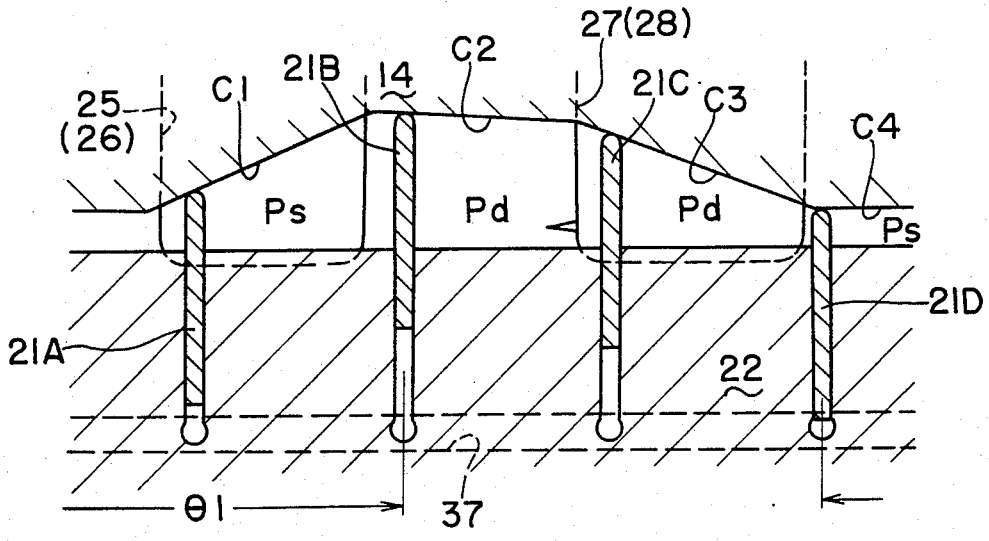
FIG. 9 is an expansion plan of the part shown in FIG. 7 illustrating still another state different from those shown in FIGS. 7 and 8.

When the state shown in FIG. 9 occurs subsequent to the state shown in FIG. 7 which occurs after the state shown in FIG. 8, the pump sector defined by the second and third vanes 21B and 21C is completely subjected to the exhaust pressure Pd, whereas the pressure in the pump sector defined by the fourth and the first vanes 21D and 21A is changed from the exhaust pressure Pd to the intake pressure Ps. However, even in this state, the leakage of pressurized fluid from the vane back pressure grooves 37, 38 toward each intake port 25 (or 26) occurs within the angular extent $\theta 1$ which is defined by three vanes, that is, the fourth, first and second vanes 21D, 21A and 21B. Accordingly, whatever angular positions the vanes 21 assume, the number of pump sectors within which the leakage of pressurized fluid occurs remains constant. This makes it possible to greatly minimize the variation in leakage volume inside the pump.

Figure 10:
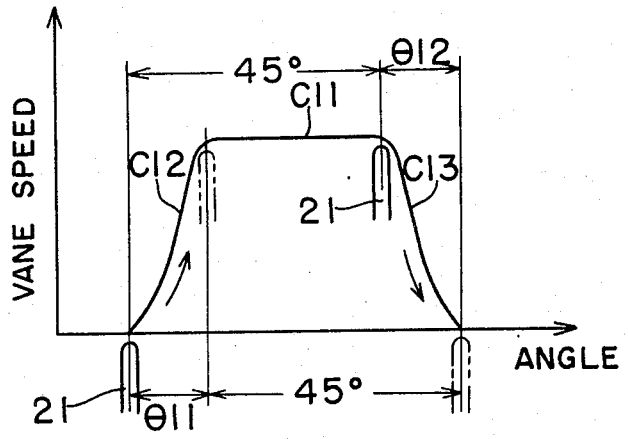
FIG. 10 is a graph indicating velocities at which each vane of the pump shown in FIG. 5 is extended radially outwardly when moving along each of intake curve sections formed at the internal cam surface of a cam ring.

Furthermore, as shown in FIG. 10, each of the intake curve sections C1 of the cam ring 14 is composed of a constant velocity curve portion C11 and a pair of smoothing curve portions C12 and C13 which are provided at front and rear sides of the constant velocity curve portion C11. The smoothing curve portions C12 and C13 are formed through respective angular extents $\theta 11$ and $\theta 12$ for accelerating and decelerating the radial movement of each vane 21 to the extent that the acceleration applied to each vane 21 does not become excessive. As a result, the velocity curve of each vane 21 at the intake curve section C1 indicates a trapezoid as shown in FIG. 10.

In addition, each of the intake curve sections C1 has such an angular width that when one vane 21 moves along one of the smoothing curve portions, e.g., C12, another vane 21 is located on the other smoothing curve portion C13 and that when one vane 21 moves along the constant velocity curve portion C11, no other vane is located within the intake curve section C1. It will therefore be understood that an angular width which the starting point of the smoothing curve portion C12 for acceleration makes with the starting point of the smoothing curve portion C13 for deceleration is equal to the vane pitch (i.e., 45 dgrees) and that an angular width which the end point of the smoothing curve portion C12 for acceleration makes with the end point of the smoothing curve portion C13 for deceleration is also equal to the vane pitch (i.e., 45 degrees). That is, the angular widths 11 and 12 of the smooting curve portions C12 and C13 respectively provided at the front and rear sides of the constant velocity curve portion C11 are set to be identical with each other, and the acceleration rate of the smoothing curve portion C12 relative to a unit angle of change is set to be identical with the deceleration rate of the smoothing curve portion C13 relative to the unit angle change.

Since the intake curve section C1 is constructed as described above, when one vane 21 moves along the constant velocity curve portion C11, only said one vane 21 moves on the intake curve section C1 at a constant velocity (CV), so that the variation in volume of the discharge fluid consumed by the vane 21 does not occur. While two vanes 21 respectively move along the smooting curve portions C12 and C13, the volume of discharge fluid consumed by the radial movement of each of the two vanes 21 varies in connection with a unit angle of rotation of the vane 21. However, the sum of the velocities of the two vanes 21 which move respectively along the acceleration smoothing curve portion C12 and the deceleration smoothing curve portion C13 is always maintained approximately at the above-noted constant velocity (CV) over the entire length of the smoothing curve portions C12 and C13, whereby the variation in the fluid volume which is consumed by the movements of the two vanes 21 along the acceleration and deceleration smoothing curve portions C12 and C13 can be avoided. Accordingly, the volume of discharge fluid consumed by the radial extension movements of one or two vanes 21 which move along each of the intake curve section C1 can be maintained to be approximately constant whatever angular position the rotor assumes, and this advantageously results in minimizing the variation in the theoretical discharge volume of the vane pump.

Figure 11:
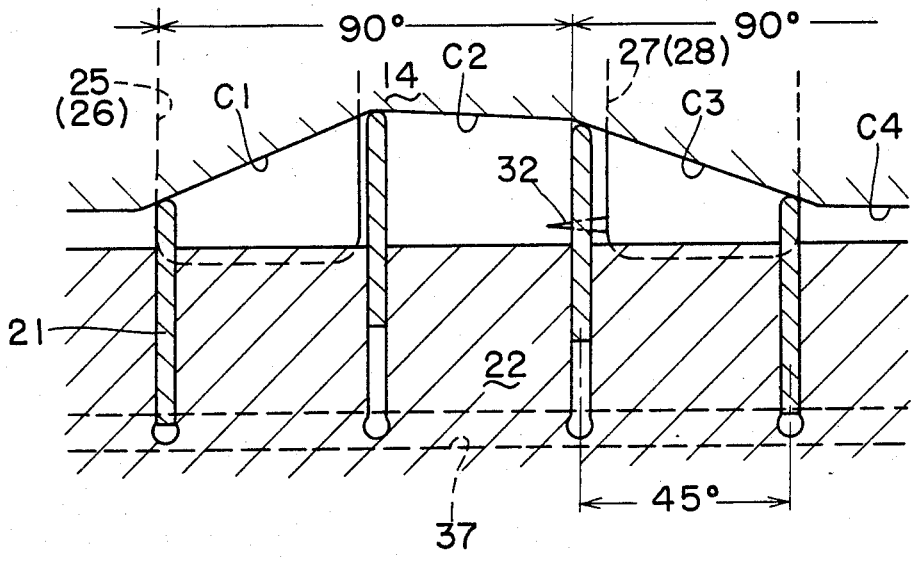
FIG. 11 is an expansion plan of a part of another embodiment of the present invention.

Although in the above-described embodiment, the angular width between the start points of each intake port 25 (or 26) and each exhaust port 27 (or 28) is chosen to be twice the vane pitch, that is, to 90 degrees, it may be chosen, if desired, to be another angular width which is slightly larger than 90 degrees, as shown in FIG. 11. In this case or in the second embodiment, it is necessary to provide a lead 32 which has such a length as to extend across an angular position which is spaced 90 degrees from the starting point of the intake port 25 (or 26). The lead 32 gradually spreads from an angular position which is spaced slightly less than 90 degrees from the starting point of the intake port 25 (or 26). This lead 32 not only acts as a leading passage for preparatory compression, but also acts to provide substantially the same effect as the case wherein an angular width of 90 degrees is formed between the starting points of the intake port 25 (or 26) and the exhaust port 27 (or 28).

Obviously, numerous modifications and variations are possible in light of the above teachings. It is therefore to be understood that within the scope of the appended claims, the present invention may be practiced otherwise than as specifically described herein.

What is claimed is:

1. A vane pump for pumping fluid, comprising:

a pump housing a cam ring received in said pump housing and formed with an internal cam surface therein;

a rotor disposed within said cam ring and having a plurality of vane support slits formed equiangularly therein;

a drive shaft rotatably disposed within said pump housing for rotating said rotor;

a plurality of vanes respectively disposed within said vane support slits of said rotor, said vanes being radially extensible from said rotor for moving along said internal cam surface when said rotor is rotated;

at least one side plate received in said pump housing in contact engagement with one end surface of said cam ring;

a pair of intake ports formed on said at least one side plate for leading fluid into a pump chamber defined by said internal cam surface of said cam ring, said rotor and said at least one side plate;

a pair of exhaust ports formed on said at least one side plate for discharging fluid pressurized in said pump chamber;

a lead formed on said at least one side plate and extending circumferentially from the start point of each of said exhaust ports toward one of said intake ports for gradually introducing high pressure fluid in each of said exhaust ports into a pump sector which any consecutive two of said vanes isolated from said intake and exhaust ports when moving between one of said intake ports and one of said exhaust ports; and an annular vane back pressure groove formed on said at least one side plate and communicating with said exhaust ports for applying pressurized fluid to all of said vane support slits; wherein:

said cam ring is formed at said internal cam surface with a pair of diametrically opposed intake curve sections, each of which is composed of a constant velocity curve portion and acceleration and deceleration curve portions respectively provided at front and rear sides of said constant velocity curve portion; and wherein the angular width between starting points of said acceleration and deceleration curve portions and the angular width between the end points of said acceleration and deceleration curve portions are equal to the pitch of said vanes.

2. A vane pump for pumping fluid, comprising:

a pump housing;

a cam ring received in said pump housing and formed with an internal cam surface therein;

a rotor disposed within said cam ring and having a plurality of vane support slits formed equiangularly therein;

a drive shaft rotatably disposed within said pump housing for rotating said rotor;

a plurality of vanes respectively disposed within said vane support slits of said rotor, said vanes being radially extensible from said rotor for moving along said internal cam surface when said rotor is rotated;

at least one side plate received in said pump housing in contact engagement with one end surface of said cam ring;

a pair of intake ports formed on said at least one side plate for leading fluid into a pump chamber defined by said internal cam surface of said cam ring, said rotor and said at least one side plate;

a pair of exhaust ports formed on said at least one side plate for discharging fluid pressurized in said pump chamber;

a lead formed on said at least one side plate and extending circumferentially from the start point of each of said exhaust ports toward one of said intake ports for gradually introducing high pressure fluid in each of said exhaust ports into a pump sector which any consecutive two of said vanes isolated from said intake and exhaust ports when moving between one of said intake ports and one of said exhaust ports; and an annular vane back pressure groove formed on said at least one side plate and communicating with said exhaust ports for applying pressurized fluid to all of said vane support slits;

the angular width between the starting point of each of said intake ports and the starting point of one of said exhaust ports being twice the pitch of said vanes, and the angular width of each of said exhaust ports being not larger than an angular width formed by outer end surfaces of two consecutive vanes; wherein:

said cam ring is formed at said internal cam surface with a pair of diametrically opposed intake curve sections;

each of said intake curve sections is composed of a constant velocity curve portion and acceleration and deceleration curve portions respectively provided at front and rear sides of said constant velocity curve portion; and wherein the angular width between starting points of said acceleration and deceleration curve portions and the angular width between the end points of said acceleration and deceleration curve portions are equal to the pich of said vanes.

3. A vane pump as set forth in claim 2, wherein:

the angular width of each of said intake curve sctions is slightly larger than that of each of said intake ports.

* * * * *